US005159244A

United States Patent [19]

Poulson

[11] Patent Number: 5,159,244

[45] Date of Patent: Oct. 27, 1992

[54] IGNITION CIRCUIT FOR GAS DISCHARGE LAMP

[76] Inventor: Daniel A. Poulson, 1719 Santa Maria Dr., Stevensville, Mich. 49127

[21] Appl. No.: 731,426

[22] Filed: Jul. 17, 1991

[51] Int. Cl.[5] ..... H05B 37/00

[52] U.S. Cl. ..... 315/205; 315/241 R; 315/245; 315/DIG. 5

[58] Field of Search ..... 315/205, 241 R, 245, 315/DIG. 5

[56] References Cited

U.S. PATENT DOCUMENTS

| | | | |
|---|---|---|---|
| 4,394,603 | 7/1983 | Widmayer | 315/205 |
| 4,463,285 | 7/1984 | Nilssen | 315/205 |

FOREIGN PATENT DOCUMENTS

| | | | |
|---|---|---|---|
| 1274230 | 8/1968 | Fed. Rep. of Germany | 315/205 |
| 197804 | 4/1978 | Fed. Rep. of Germany | 315/205 |

OTHER PUBLICATIONS

Donald G. Fink, Standard Handbook for Electrical Engineers, McGraw-Hill Book Company, Tenth Edition, Title Page and pp. 19-22 and 19-23.

E. Molloy, The Electrical Engineer's Reference Book, George Newnes Limited, Eighth Edition, Title Page and pp. v, 12-10 to 12-20.

E. Norman Lurch, Fundamentals of Electronics, John Wiley & Sons, Inc., Second Edition, Title Page and pp. 174 to 179.

*Primary Examiner*—Eugene R. LaRoche
*Assistant Examiner*—Michael B. Shingleton
*Attorney, Agent, or Firm*—Flynn, Thiel, Boutell & Tanis

[57] ABSTRACT

A starter circuit is supplied with 120 volt 60 Hz power, and is coupled to a gas discharge lamp having in an interior thereof a gas and two spaced electrodes. When the starter circuit applies to the electrodes a voltage in excess of a threshold voltage, the lamp transitions from a non-conductive state in which no visible light is emitted to a conductive state in which visible light is emitted. The starter circuit includes several voltage doubler circuits coupled in series with each other between the electrodes of the lamp to form a voltage multiplier circuit. When the lamp is in its non-conductive state, the voltage doubler circuits each output a substantially DC voltage which is twice the maximum potential of the 120 volt input signal so that the voltage multiplier as a whole applies to the electrodes a significant DC voltage in excess of the threshold voltage so that the lamp transitions from its non-conductive state to its conductive state. In response to the transition of the lamp to its conductive state, the starter circuit applies to the lamp an AC voltage substantially less than the threshold voltage.

6 Claims, 2 Drawing Sheets

IGNITION CIRCUIT FOR GAS DISCHARGE LAMP

FIELD OF THE INVENTION

This invention relates to a starter circuit for automatically starting ionization of and light discharge from a gas discharge lamp.

BACKGROUND OF THE INVENTION

FIG. 2 shows a conventional gas discharge light apparatus 10 having a gas discharge lamp 11, which in this case is a conventional fluorescent lamp. The fluorescent lamp 11 includes an elongate glass tube 12 having sealed in opposite ends respective filaments 13 and 14 which serve as spaced electrodes within the interior of the tube. The interior of the tube is coated with phosphors. The interior of the tube contains a gas or vapor such as mercury vapor, along with a few ions. One end of the tube has two external terminals 16 and 17 which are connected to respective ends of the filament 13, and the other end of the tube 12 has two external terminals 18 and 19 which are connected to respective ends of the filament 14.

A standard plug 21 is of the type which can be connected to any standard 120 volt 60 Hz AC wall outlet, and the plug 21 is connected in series with a choke 22 between the terminals 16 and 18 of the lamp 11. The choke 22 is often referred to as a ballast. A thermal switch 23 is disposed within a neon bulb 26 and is connected in series with a resistor 27 between the terminals 17 and 19 of the lamp 11, the thermal switch 23 normally being closed and opening automatically when its temperature increases above a predetermined temperature. The spaced internal terminals of the neon bulb 26 are connected in series with resistor 27 between the terminals 17 and 19.

When the apparatus has been off for a period of time, the switch 23 will be closed. The gas in the lamp 11 will contain a minimum of ions, and will thus be substantially non-conductive. If the plug 21 is then inserted into a wall outlet, AC current will flow through electrode 13, closed switch 23, electrode 14 and choke 22. This heats the filaments 13 and 14, causing them to emit electrons within the tube. After a predetermined time, heat generated by components of the system will cause the thermal switch 23 to open, thereby interrupting the AC circuit. Because of the magnetic field around the choke 22, the choke 22 will produce a high voltage across the electrodes 13 and 14, which causes positive ions to move toward one of the electrodes and negative ions to move toward the other electrode. These ions collide with neutral atoms and impart energy to electrons of the neutral atoms, which causes the electrons to gain energy and to be displaced to an exterior orbit, the electrons eventually giving up their acquired energy in the form of electromagnetic radiation which in some cases is in a short-wave ultraviolet range which the phosphors coating the tube convert into visible light, so that the lamp 11 emits light. Some electrons will be displaced entirely from the neutral atoms, thus generating additional ions which can collide with other neutral atoms in order to increase the amount of visible light generated. The significantly increased level of ionization means the lamp 11 is now conductive.

After the momentary voltage surge from the choke 22 which ionized the gas in the lamp 11 has dissipated, the lamp will continue to operate under standard 120 volt AC power. The discharge is extinguished twice per cycle when the AC voltage is at zero, but the instantaneous restarting of the discharge requires a much lower voltage than the initial starting voltage because the majority of the ions have not had time to recombine with atoms so as to return the ion density to its original level. After the switch 23 has opened, power is applied to the neon bulb 26 and causes it to light and give off heat, the heat causing the thermal switch 23 to remain open.

Although the arrangement shown in FIG. 2 has been adequate for its intended purposes, it has not been satisfactory in all respects. In particular, it will be immediately recognized that, if one of the electrode filaments 13 or 14 burns out, the resulting open will interrupt the starting circuit and thus ionization and initiation of the discharge will not take place. Alternatively, if the input voltage at line 21 is low or if the ambient temperature is low, it can be difficult or impossible to initiate discharge from the lamp 11. Also, the predetermined time required for the thermal switch 23 to heat up and open means that the lamp does not start instantaneously. Moreover, during operation, the arrangement shown in FIG. 2 has a lagging power factor, and may tend to produce an annoying audible hum. Also, the choke 22 tends to produce heat which, over time, can cause the choke 22 to fail, often with the generation of obnoxious smells. In addition, the choke 22 is relatively large and heavy, and the overall starter circuit is thus not compact and lightweight.

Another known approach is to rectify and filter a standard 120 volt AC signal in order to produce a DC signal, and to use the DC signal to power a circuit which includes a 25 KHz oscillator, the resulting 25 KHz signal being applied to the gas discharge lamp in order to produce excitation which initiates ionization and discharge. However, the use of a 25 KHz signal means that the device must be approved by the Federal Communications Commission (FCC), and even with approval it may generate electromagnetic fields which will interfere with the operation of other devices such as radios, televisions, and computers. Because of these disadvantages, this approach is not widely used, and is not illustrated or described in further detail here.

An object of the invention is to provide a starter circuit for a gas discharge lamp which will reliably light the lamp in a substantially instantaneous manner even at relatively low line voltages, and which produces no noticeable flicker.

A further object is to provide such a starter circuit which avoids the use of a transformer or a ballast or choke, and which is relative compact.

It is a further object to provide such a starter circuit which generates minimal heat and which transfers power with a high level of efficiency from a power source to the lamp.

It is a further object to provide such a starter circuit which, in the case of a lamp such as a standard fluorescent light having one or more internal electrode filaments connected between respective external terminals, can reliably and substantially instantaneously initiate ionization and discharge even when the filament is broken.

A further object is to provide such a starter circuit which is inexpensive, requires no maintenance, and has a long operational lifetime.

SUMMARY OF THE INVENTION

The objects and purposes of the invention, including those set forth above, are met by providing an arrangement which includes a gas discharge lamp having in an interior thereof a gas and two spaced electrodes, and a starter circuit having two input terminals and two output terminals each coupled to a respective one of the electrodes of the lamp. When a voltage in excess of a threshold voltage is applied to the electrodes of the lamp, the lamp transitions from a non-conductive state free of visible light emission to a conductive state in which visible light is emitted. The starter circuit includes an arrangement responsive to an input voltage and responsive to the lamp being respectively in its non-conductive and conductive states for respectively applying first and second voltages to the electrodes, the first voltage being substantially greater than the second voltage, and the first and second voltages being respectively greater than and less than the threshold voltage.

BRIEF DESCRIPTION OF THE DRAWINGS

A preferred embodiment of the invention is described in detail hereinafter with reference to the accompanying drawings, in which.

DETAILED DESCRIPTION

Figure 1:
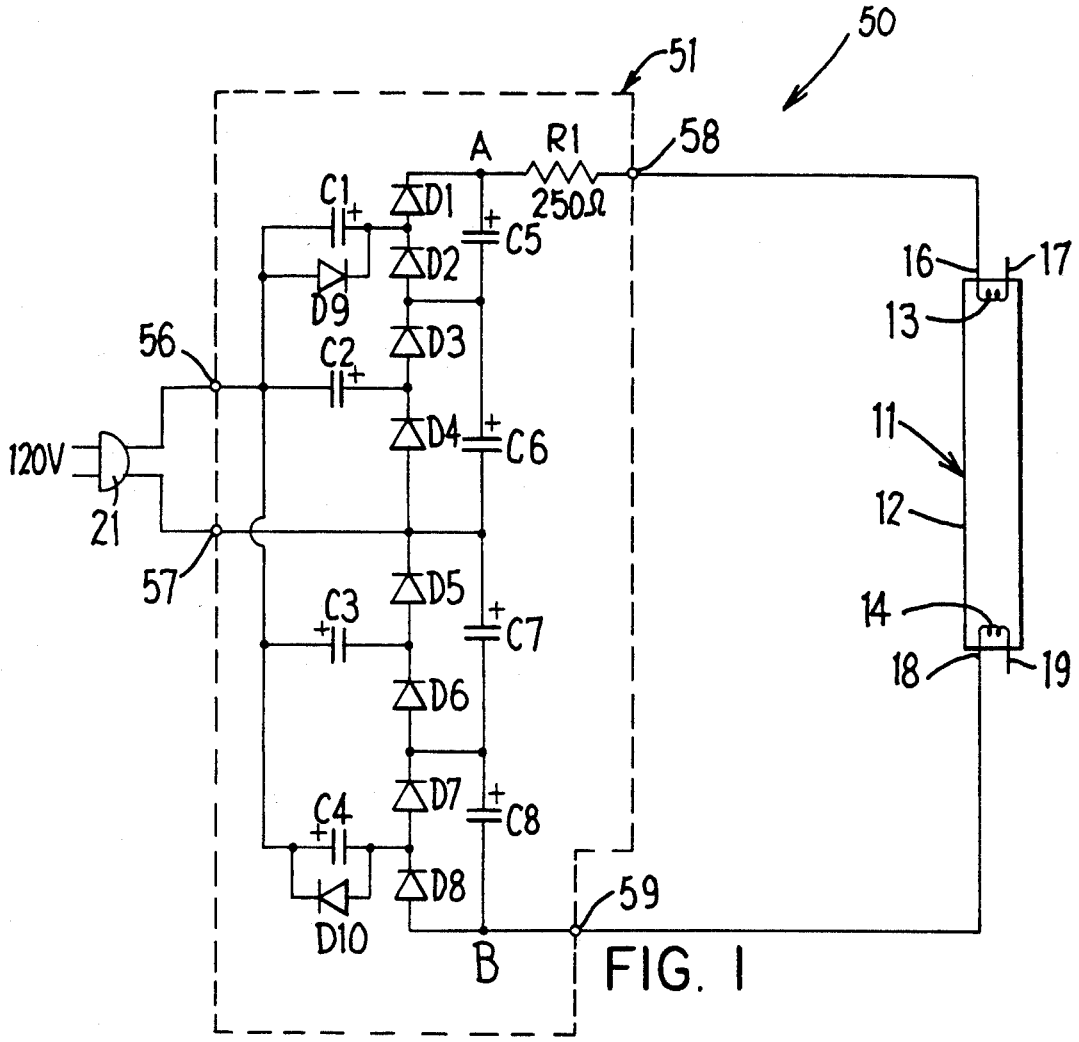
FIG. 1 is a schematic diagram of a gas discharge lamp and a starter circuit for the lamp which embodies the present invention.

FIG. 1 depicts a fluorescent lamp apparatus 50 which embodies the present invention. The apparatus 50 includes a fluorescent lamp 11 and a plug 21 which are identical to those discussed above in association with FIG. 2, and which are therefore designated with the same reference numerals. The apparatus 50 also includes a starter circuit 51, which is the focus of the present invention and is described in detail below.

The starter circuit 51 has two input terminals 56 and 57 to which the plug 21 is connected, and has two output terminals 58 and 59 which are respectively connected to the terminals 16 and 18 of the lamp 11. It will be noted that the terminals 17 and 19 of the lamp 11 are not connected to the circuit 51, although they could each be optionally connected to the respective adjacent terminals 16 or 18.

The terminal 58 is connected through a 250 Ω, 1 watt power resistor R1 to a node A, and the output terminal 59 is connected directly to a circuit node B. Four capacitors C5, C6, C7 and C8 are connected in series with each other between the nodes A and B. A pair of silicon diodes D1 and D2 are connected in series with each other between the ends of the capacitor C5, the cathode of diode D1 being connected to node A, the cathode of diode D2 being connected to the anode of diode D1, and the anode of diode D2 being connected to the end of capacitor C5 remote from node A. In a similar manner, three additional pairs of silicon diodes D3 and D4, D5 and D6, and D7 and D8 are respectively connected across capacitor C6, capacitor C7 and capacitor C8.

The node between the diodes of each pair is connected to the input terminal 56 through a respective capacitor C1, C2, C3, or C4. The input terminal 57 is connected to the node between capacitors C6 and C7, and thus also to the anode of diode D4 and the cathode of diode D5.

A further silicon diode D9 is connected in parallel with the capacitor Cl, the anode of diode D9 being connected to input terminal 56. Another silicon diode D10 is connected in parallel with capacitor C4, the cathode of diode D10 being connected to input terminal 56.

Capacitors C2 and C6 and diodes D3 and D4 together constitute a known circuit commonly referred to as a voltage doubler. The operation of this voltage doubler circuit is described in more detail later, but in essence it charges capacitor C6 to a DC voltage which is substantially twice the maximum instantaneous AC potential present at any time between input terminals 56 and 57. Similarly, capacitors C1 and C5 and diodes D1 and D2 together serve as a voltage doubler, capacitors C3 and C7 and diodes D5 and D6 together serve as a voltage doubler, and capacitors C4 and C8 and diodes D7 and D8 together serve as a voltage doubler. The four voltage doublers are essentially stacked, and such a stacked arrangement of voltage doublers is commonly referred to as a voltage multiplier.

As is commonly known, voltage regulation is a measure of the change of load voltage in response to a change in load current. A characteristic of the voltage doubler/multiplier circuit is that output voltage regulation is very poor. In particular, the output voltage in the absence of a load is significantly higher than the output voltage when a load is applied. Consequently, while interesting from a theoretical perspective, voltage doubler/multiplier circuits have rarely been used in practice because the doubled/multiplied voltage cannot be delivered to any significant load. However, a part of the present invention is the recognition that this poor regulation characteristic, normally regarded as disadvantageous, is highly advantageous in the context of a starter circuit for a gas discharge lamp, as will be evident from the following explanation of the operation of the inventive starter circuit.

OPERATION

If the input terminal 57 is viewed as a reference point, application of a standard 120 volt rms AC signal (170 volts peak) to the input terminals 56 and 57 means the input terminal 56 alternates with a sine wave format between peaks of +170 volts and −170 volts relative to terminal 57. Thus, the maximum potential between terminals 56 and 57 at any given point in time is 170 volts.

Focusing first on the voltage doubler which includes capacitors C2 and C6 and diodes D3 and D4, when 120 V power is first applied to the input terminals, the first half of a sine wave cycle at terminals 56 and 57 causes current to flow through diode D4 and charge capacitor C2 to a DC value of 170 volts. The polarity of the voltage at terminals 56 and 57 reverses during the next half of the sine wave cycle, during which the maximum potential of 170 volts between terminals 56 and 57 is effectively in series with the 170 V DC bias on capacitor C2, thereby producing a combined voltage of 340 volts so that, through diode D3, capacitor C6 is charged to 340 volts.

Simultaneous with charging of capacitor C6 in this manner, the other voltage doublers are charging each of capacitors C5, C7 and C8 in an analogous manner to respective DC potentials which are each approximately 340 volts. Since the capacitors C5, C6, C7 and C8 are in series, the total voltage across them is $340 \times 4 = 1{,}360$ volts. Since lamp 11 is substantially non-conductive at this point, there will be little or no current flow through the power resistor R1, and there will thus be little or no voltage drop across resistor R1. Consequently, substantially the entire DC potential of about 1,360 volts is applied between terminals 16 and 18 (and thus electrodes 13 and 14) of the lamp 11. This voltage is sufficient to almost instantaneously initiate ionization and discharge within the tube 11, so that more current begins flowing between electrodes 13 and 14 through the gas in tube 11 and through resistor R1. This current will draw most of the charge from the four capacitors C5–C8, and the voltage between output terminals 58 and 59 will change from the relatively high DC voltage which was present on capacitors C5–C8 to a lower AC voltage. This AC signal has a peak-to-peak voltage substantially less than the relatively high DC voltage which was present on capacitors C5–C8 prior to ionization.

Figure 3:
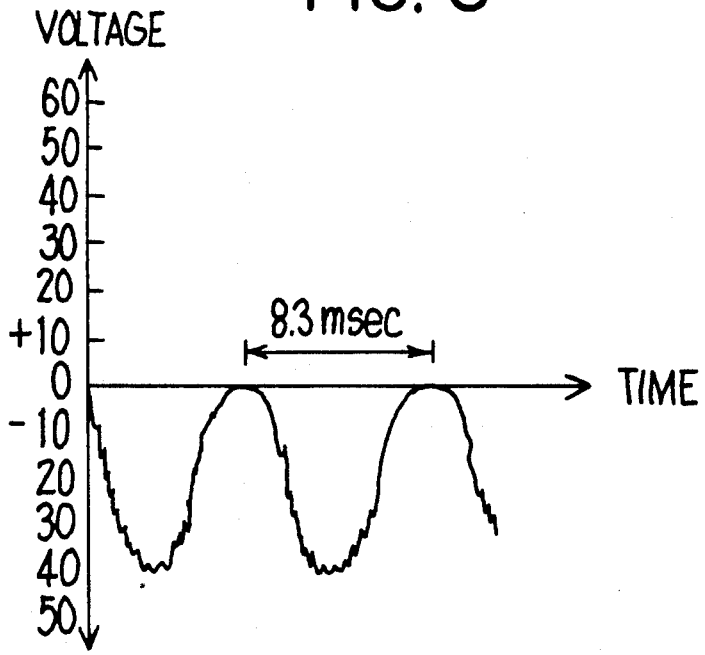
FIG. 3 is a graph showing an AC voltage across a resistor which is a component of the embodiment of FIG. 1.
Figure 4:
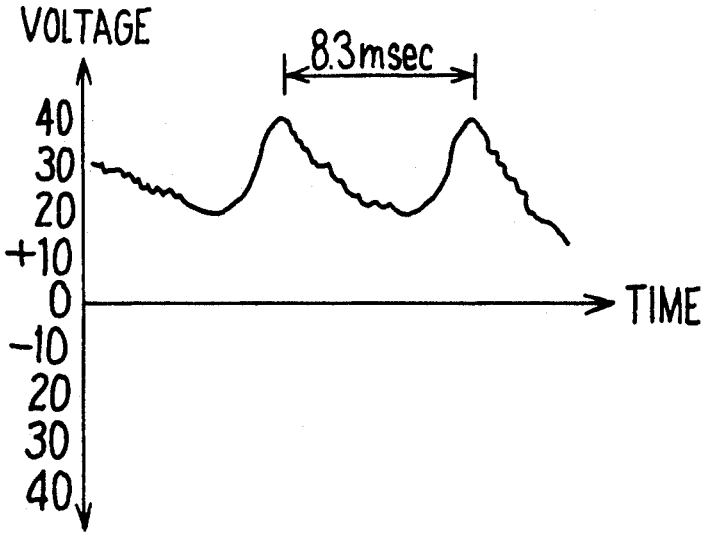
FIG. 4 is a chart showing an AC voltage across the lamp of the embodiment of FIG. 1.

In particular, during a first half of each sine wave cycle, current flows from terminal 56 through diode D9, diode D1, resistor R1, lamp 11, diode D8, diode D7, diode D6 and diode D5 to terminal 57. During the other half of each sine wave cycle, current flows from terminal 57 through diode D4, diode D3, diode D2, diode D1, resistor R1, lamp 11, diode D8, and diode D10 to terminal 56. It will be noted that current flows in the same direction through the lamp 11 during both halves of each sine wave cycle, because the diodes essentially effect full wave rectification of the standard 120 V AC signal present at the input terminals 56 and 57. The capacitors C5–C8 do not fully discharge, and thus the voltage across the resistor R1 and lamp 11 never drops completely to zero. Thus, the starter circuit 51 causes current to flow through the lamp 11 in a single direction at all times during operation of the lamp 11. In the preferred embodiment, the capacitors tend to shape the rectified waveform by rounding out the valleys between the positive peaks so that the unidirectional current through the lamp 11 varies in magnitude in a manner which approximates a sine wave at 120 Hz (double the 60 Hz line frequency).

Where the lamp 11 is a standard 15 watt fluorescent bulb and resistor R1 is 250 Ω, FIG. 3 shows the voltage across resistor R1 (the voltage at node A with reference to terminal 58) and FIG. 4 shows the voltage across lamp 11 (the voltage at terminal 18 with reference to terminal 16).

When the plug 21 is first inserted in a 120 V 60 Hz wall outlet to apply power to the arrangement of FIG. 1, the capacitors C5–C8 will each be charged to about 340 volts within theoretically one or two full sine wave cycles of the input signal, and thus ionization and discharge of the lamp 11 should begin in about 1/60th to 1/30th of a second or in other words almost instantaneously. The filaments 13 and 14 merely serve as electrodes and not heating elements, and thus it is possible for the lamp 11 to promptly light even if one of the filaments 13 or 14 is broken, whereas in the conventional arrangement of FIG. 2 a broken filament would render the lamp inoperative. The number of capacitors C5–C6 each carrying the doubled input voltage has been selected so that the total resulting voltage applied to the lamp 11 will be sufficient to start ionization and discharge even if the line voltage is relatively low, for example about 100 volts 60 Hz AC.

Figure 2:
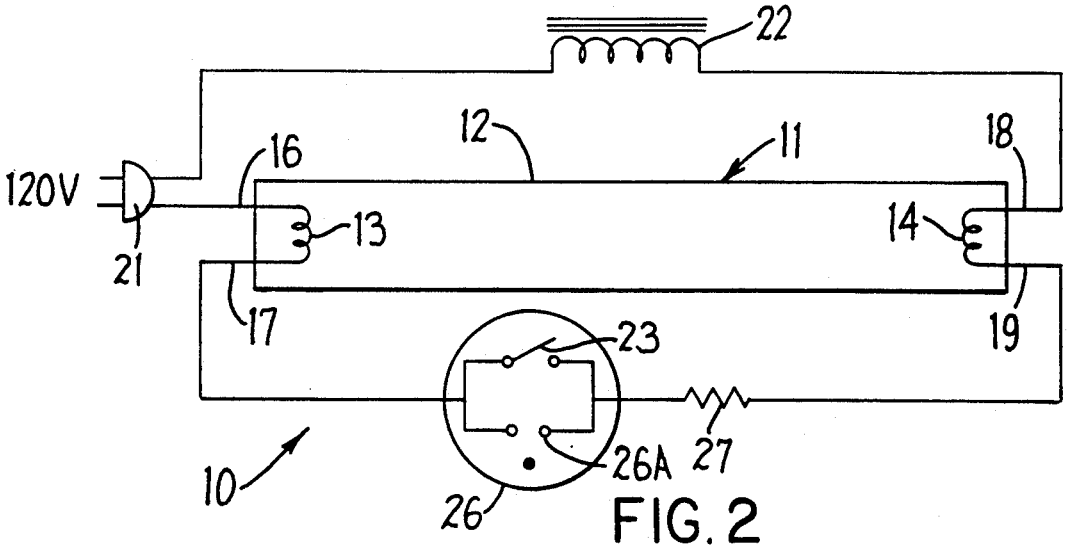
FIG. 2 PRIOR ART
FIG. 2 is a view of a conventional apparatus which includes a gas discharge lamp and a circuit for starting the lamp.

In the known arrangement of FIG. 2, the current through the lamp 11 reverses directions between successive half waves of the sine cycle, and thus there are two points during each sine wave cycle when current flow is momentarily zero and the discharge stops. There can thus be a degree of flicker. In contrast, the starter circuit 51 of FIG. 1 effects varying current flow in a single direction and has the capacitors C5–C8 to maintain a potential at the lamp 11 even when the voltage at input terminals 56 and 57 is zero, thereby avoiding or minimizing cessation of the light discharge and thus minimizing any tendency for flicker. Moreover, the inventive starter circuit 51 of FIG. 1 avoids the use of a transformer or a choke or ballast, and is thus somewhat more compact and lightweight than the known starter circuit of FIG. 2. The inventive starter circuit has a power factor close to unity, and does not produce an audible hum. It will be recognized that the value of resistor R1 can be changed in order to vary the brightness of lamp 11. In fact, two such resistors with different values could be provided, and a switch could be provided to couple a selected one of them into the circuit so that a user has a two-stage brightness control. Alternatively, the 250 Ω resistor R1 could be replaced with a variable resistor such as a rheostat.

If the capacitors C1 and C4 are sufficiently large, it is possible to omit diodes D9 and D10 from the circuit of FIG. 1. However, there may be a perceptible flicker and reduced low voltage performance.

While the preferred embodiment has been disclosed in association with a fluorescent lamp, it will be recognized that the invention can be used with other types of gas discharge lamps, for example a conventional mercury vapor lamp.

Although a single preferred embodiment of the invention has been illustrated and described for illustrative purposes, it will be recognized that there are variations and modifications of the disclosed embodiment, including the rearrangement of parts, which lie within the scope of the claims.

The embodiments of the invention in which an exclusive property or privilege is claimed are defined as follows:

1. An apparatus comprising:

a gas discharge lamp which has in an interior thereof a gas and two spaced electrodes and which, in response to application to said electrodes of a voltage in excess of a threshold voltage, transitions from a non-conductive state free of visible light emission to a conductive state in which visible light is emitted; and a starter circuit having first and second input terminals, having first and second output terminals each connected to a respective one of said electrodes of said lamp, and having circuit means responsive to an input voltage at said input terminals and responsive to said lamp being respectively in said non-conductive and conductive states for respectively applying first and second voltages to said electrodes, said first voltage being substantially greater than said second voltage, and said first and second voltages being respectively greater than and less than said threshold voltage;

wherein said circuit means includes a first capacitor having a first end coupled to said first output terminal and having a second end, a second capacitor having a first end connected to said second end of said first capacitor and having a second end connected to said first input terminal, a third capacitor having a first end connected to said second end of said second capacitor and having a second end, a fourth capacitor having a first end connected to said second end of said third capacitor and having a second end coupled to said second output terminal, a first diode having an anode connected to said first end of said first capacitor and having a cathode, a second diode having an anode connected to said cathode of said first diode and having a cathode connected to said second end of said first capacitor, a third diode having an anode connected to said first end of said second capacitor and having a cathode, a fourth diode having an anode connected to said cathode of said third diode and having a cathode connected to said second end of said second capacitor, a fifth diode having an anode connected to said first end of said third capacitor and having a cathode, a sixth diode having an anode connected to said cathode of said fifth diode and having a cathode connected to said second end of said third capacitor, a seventh diode having an anode connected to said first end of said fourth capacitor and having a cathode, an eight diode having an anode connected to said cathode of said seventh diode and having a cathode connected to said second end of said fourth capacitor, a fifth capacitor having a first end connected to said cathode of said first diode and having a second end connected to said second input terminal, a sixth capacitor having a first end connected to said cathode of said third diode and having a second end connected to said second input terminal, a seventh capacitor having a first end connected to said cathode of said fifth diode and having a second end connected to said second input terminal, an eight capacitor having a first end connected to said cathode of said seventh diode and having a second end connected to said second input terminal, a ninth diode having an anode connected to said cathode of said first diode and having a cathode connected to said second input terminal, and a tenth diode having a cathode connected to said anode of said eight diode and having an anode connected to said second input terminal.

2. An apparatus comprising:

a gas discharge lamp which has in an interior thereof a gas and two spaced electrodes and which, in response to application to said electrodes of a voltage in excess of a threshold voltage, transitions from a non-conductive state free of visible light emission to a conductive state in which visible light is emitted; and a starter circuit having two input terminals, and having two output terminals each coupled to a respective one of said electrodes of said lamp, said starter circuit having means responsive to an input voltage at said input terminals and responsive to said lamp being respectively in said non-conductive and conductive states for respectively applying first and second voltages to said electrodes, said first voltage being substantially greater than said second voltage, and said first and second voltages being respectively greater than and less than said threshold voltage;

wherein said starter circuit includes a voltage multiplier circuit having means responsive to said lamp being in said non-conductive state for producing at said output terminals a voltage which is said first voltage and is a multiple of a voltage applied to said input terminals;

wherein said voltage multiplier circuit includes a plurality of voltage doubler circuits having outputs connected in series with each other between said output terminals of said voltage multiplier circuit and having inputs coupled to said input terminals of said voltage multiplier circuit, each said voltage doubler circuit having means for producing at said outputs thereof a DC voltage which is twice a maximum difference produced between said input terminals in response to an AC signal;

wherein each said voltage doubler circuit includes a first capacitor having first and second ends which respectively serve as said outputs of said voltage doubler circuit, first and second diodes connected in series with each other so that a cathode of said first diode is connected to said first end of said first capacitor, a cathode of said second diode is connected to an anode of said first diode, and an anode of said second diode is connected to said second end of said first capacitor, and a second capacitor having a first end connected to said anode of said first diode and a second end connected to one of said input terminals;

wherein one of said voltage doubler circuits includes a diode having an anode directly connected to said one of said input terminals and a cathode directly connected to said anode of said first diode of said one of said voltage doubler circuits, and wherein another of said voltage doubler circuits includes a diode having a cathode directly connected to said one of said input terminals and having an anode directly connected to said cathode of said second diode thereof.

3. An apparatus of claim 2, including a resistor which effects said coupling of one of said electrodes of said lamp to one of said output terminals of said voltage multiplier circuit.

4. An apparatus of claim 1, wherein said circuit means includes a resistor having a first end connected to said second end of said fourth capacitor and having a second end connected to said second output terminal.

5. An apparatus comprising:

a gas discharge lamp which has in an interior thereof a gas and two spaced electrodes and which, in response to application to said electrodes of a voltage in excess of a threshold voltage, transitions from a non-conductive state free of visible light emission to a conductive state in which visible light is emitted; and a starter circuit having first and second input terminals, having first and second output terminals each connected to a respective one of said electrodes of said lamp, and having circuit means responsive to an input voltage at said input terminals and responsive to said lamp being respectively in said non-conductive and conductive states for respectively applying first and second voltages to said electrodes, said first voltage being substantially greater than said second voltage, and said first and second voltages being respectively greater and less than said threshold voltage;

wherein said circuit means includes a first capacitor having a first end connected to said first output terminal and having a second end, a second capacitor having a first end coupled to said second end of said first capacitor and to said first input terminal and having a second end coupled to said second output terminal, a fist diode having an anode connected to said first end of said first capacitor and having a cathode, a second diode having an anode connected to said cathode of said first diode and having a cathode connected to said second end of said first capacitor, a third diode having an anode connected to said first end of said second capacitor and having a cathode, a fourth diode having an anode connected to said cathode of said third diode and having a cathode connected to said second end of said second capacitor, a third capacitor having a first end connected to said cathode of said first diode and having a second end connected to said second input terminal, a fourth capacitor having a first end connected to said anode of said fourth diode and having a second end connected to said second input terminal, a fifth diode having an anode connected to said cathode of said first diode and having a cathode connected to said second input terminal, and a sixth diode having a cathode connected to said anode of said fourth diode and having an anode connected to said second input terminal.

6. An apparatus of claim 5, wherein said circuit means includes a resistor having a first end connected to said second end of said second capacitor and having a second end connected to said second output terminal.

* * * * *